US005597031A

United States Patent [19]

Weimann

[11] Patent Number: 5,597,031

[45] Date of Patent: Jan. 28, 1997

[54] PROCESS AND DEVICE FOR THE UNPACKING OF CASTING CLUSTERS

[75] Inventor: Wendelin Weimann, Klettgau, Germany

[73] Assignee: Georg Fischer Giessereianlagen AG, Schaffhausen, Switzerland

[21] Appl. No.: 385,096

[22] Filed: Feb. 7, 1995

[30] Foreign Application Priority Data

Feb. 11, 1994 [CH] Switzerland ..... 00410/94

[51] Int. Cl.[6] ..... B22D 29/02; B22D 47/00

[52] U.S. Cl. ..... 164/270.1; 164/404; 164/344

[58] Field of Search ..... 164/269, 270.1, 164/76.1, 404, 131, 344

[56] References Cited

U.S. PATENT DOCUMENTS 3,727,677 4/1973 Thomas ..... 164/344
4,359,083 11/1982 Jacobsen ..... 164/344
4,643,243 2/1987 McKibben et al. ..... 164/404

FOREIGN PATENT DOCUMENTS 62-38754 2/1987 Japan .

*Primary Examiner*—Joseph J. Hail, III
*Assistant Examiner*—Randolph S. Herrick
*Attorney, Agent, or Firm*—Bachman & LaPointe, P.C.

[57] ABSTRACT

A process and a device are proposed for the casting and unpacking of clusters which, after the casting, after passage over a primary cooling path, are freed by jolting from the surrounding molded clump consisting of mold sand, whereupon, after passage over a secondary cooling path, the individual castings are separated from the cluster. The cluster is cast with a hanger which is present in front in the direction of transport, and the molded clump is conveyed over a discharge shaft for old sand against a transport hook in the manner that the hanger with the transport hook suspended, swings downward, throwing off the predominant quantity of old sand from the molded clump, whereupon the cluster is jolted.

2 Claims, 3 Drawing Sheets

PROCESS AND DEVICE FOR THE UNPACKING OF CASTING CLUSTERS

BACKGROUND OF THE INVENTION

The present invention relates to a process for the unpacking of casting clusters which, after the casting and passage through a primary cooling path, are freed of molding sand, whereupon they pass through a secondary cooling path.

The invention also relates to a device for carrying out this process.

It is known to cast castings as casting clusters, in which case the individual castings of the casting clusters are connected to each other by a system of runner and gates. As a rule, the cast casting clumps pass over a primary cooling path. The castings are then solidified to such an extent that the casting clumps can be ejected from the edges of the mold and the casting clusters unpacked, i.e. freed of the sand. This is effected, for instance, by means of jolting or vibratory knock-out grid onto an underfloor conveyor and is fed to the sand treatment plant, while the cluster is conveyed further along a secondary cooling path before the castings are knocked off.

SUMMARY OF THE INVENTION

The object of the present invention is to provide a process and an apparatus which permit a simple unpacking and transfer of clusters to a secondary cooling path.

BRIEF DESCRIPTION OF THE DRAWINGS

The invention will be further described below on basis of an embodiment shown in the accompanying drawings, in which:

FIG. 4 shows a flow diagram for a foundry process comprising a sand mold making station, a casting station, primary cooling path, an unpacking station in accordance with the present invention and a secondary cooling station.

DETAILED DESCRIPTION

Figure 1:
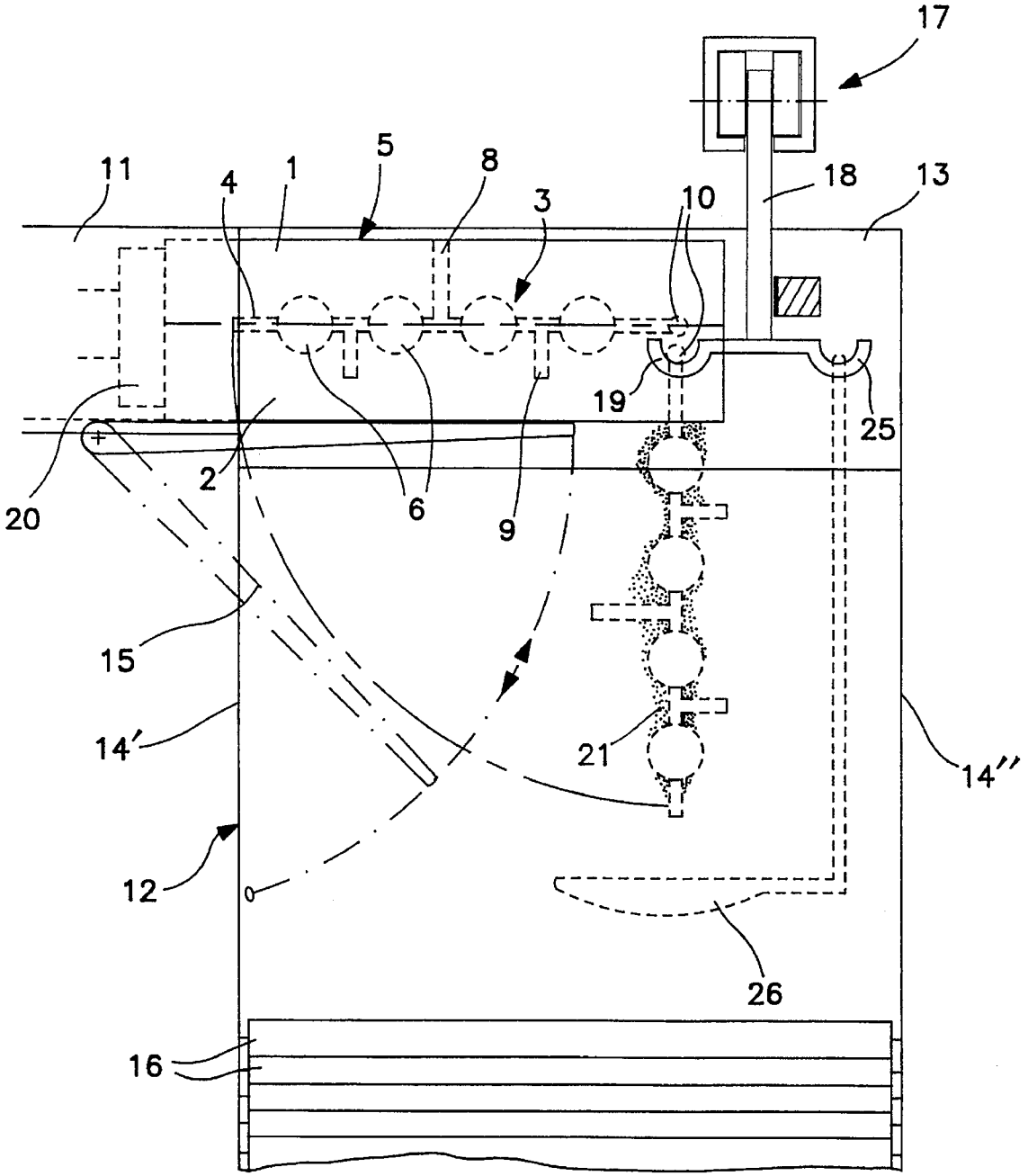
FIG. 1 shows diagrammatically a portion of an unpacking station.
Figure 2:
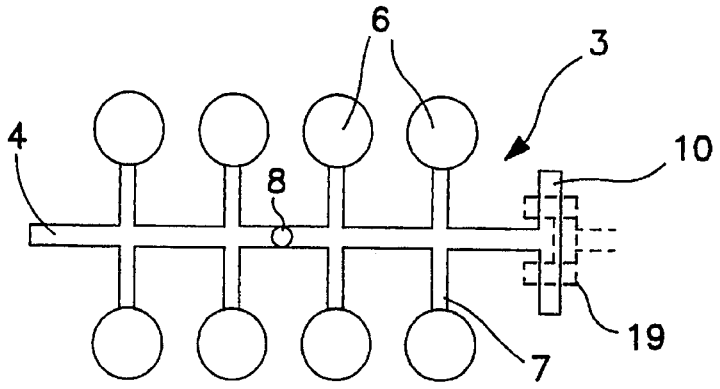
FIG. 2 is a top view of a cluster.
Figure 3:
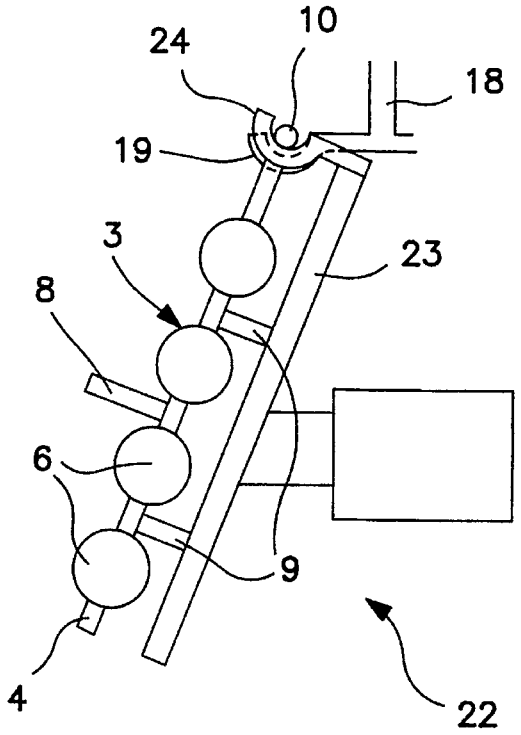
FIG. 3 is a diagrammatic view of part of a jolting device.
Figure 4:
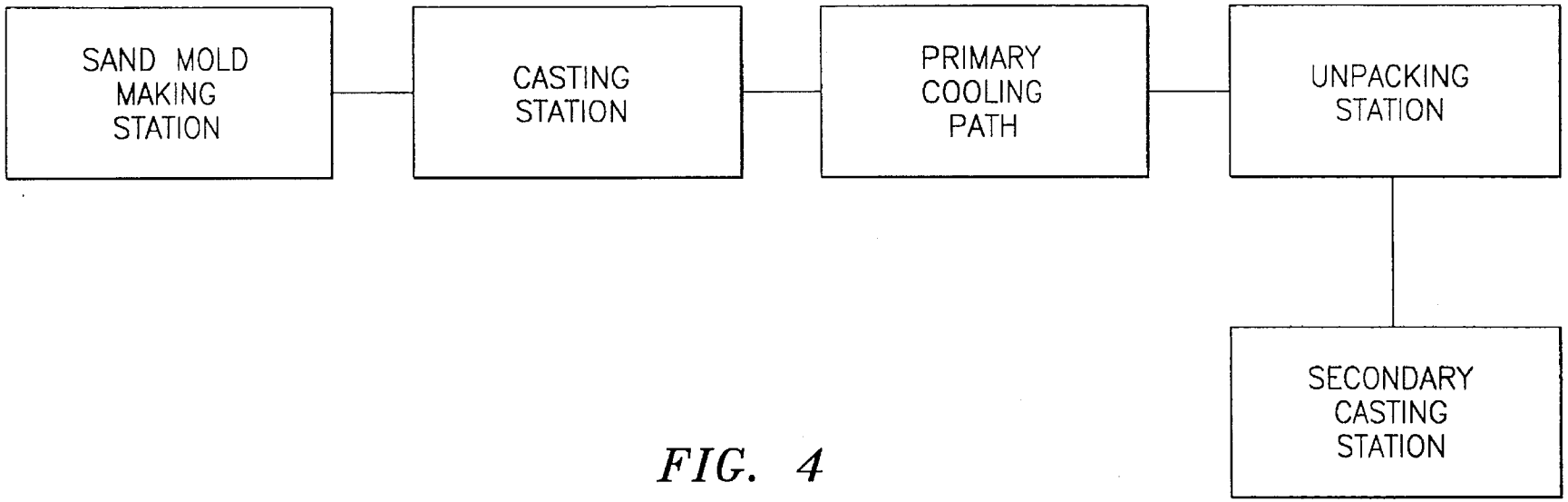
FIG. 4 is a flow diagram of the overall process employing the unpacking station of the present invention.

A sand mold consisting of an upper mold half and a lower mold half (in corresponding molding boxes or without molding boxes) is produced by forming sand around a suitable pattern present on a pattern plate. Molten metal is then poured into the sand mold. In this way, a cluster 3, such as shown in FIGS. 1 and 2 is, for instance, produced.

The cluster 3 has a runner 4. This runner is developed as a central bar which is arranged in the parting plane between the cope 1 and drag 2. On both sides of this central bar there are arranged, symmetrically or asymmetrically to each other, the individual castings 6, which are connected via a second runner 7 to the runner 4. From the longitudinal axis of the cluster 3 there extend, from the runner 4, on the one side, a sprue 8 formed by the pouring basin and, on the other side, two separately developed sprues 9. On one end of the runner 4 there is cast a hanger bar 10 which forms a transverse bar the center axis of which extends perpendicular to the longitudinal axis of the runner 4. The hanger 10, can, however, also be developed as an eye or the like.

Regardless of the size of the pattern plate and the shape of the pattern, the central runner 4 or several runners are always provided with the hanger 10 in the same position.

The molded clump 5 which constitutes the individual castings 6 in the form of a cluster 3 within the sand mold passes through a primary cooling path the length of which is so selected that the castings have a strength sufficient for unpacking when they reach the unpacking station. At the end of the primary cooling path, the molded clumps 5, if they are in molding boxes, are ejected from them and conducted into an approximately horizontal molded-clump shaft 11.

The molded-clump shaft 11 opens in the upper region of a discharge shaft 12 for old sand, the shaft being formed of a rear wall 13, side walls 14', 14", and a bottom 15. The bottom 15 opens to expose a grid formed by roller 16 below which there is a conveyor for old sand.

A conveyor 17 is provided which has a plurality of upwardly open transport hooks 19 which are arranged on conveyor units 18. The conveyor 17 passes over the discharge shaft 12. The transport hook 19, which is developed as a double hook, is arranged below and centrally to the principal plane of the cluster 3 so that, upon the ejection of the molded clump from the molded-clump shaft, the transport hook 19 can engage the hanger 10 of the molded clump.

The molded clump 5 present in the molded-clump shaft 11 is pushed with the hanger 10 in transport direction along the molded-clump shaft 11 by means of a push member 20 over the discharge shaft 12 against the transport hook 19 so that the latter penetrates the mold and attaches to the molded clumps 5 below the central runner 4 and the hanger 10 into the molding sand, until it is located approximately below the hanger 10. The weight of the molded clump 5 with the cluster 3 effects an engagement with the transport hook 19 upon the lowering of the molded clump by the lowering flap 15 and a simultaneous dropping down of the molded clump 5 into the discharge shaft 12. In this connection, the hanger 10 is firmly engaged by the transport hook 19 so that the cluster 3 with residual molding sand 21 hangs perpendicularly from the transport hook 19, while substantially all of the molding sand has dropped off. The molding sand is then taken up by the discharge shaft 12.

The cluster 3, together with the adhering residues of molding sand, is conducted over the discharge shaft 12 into a position adjacent to one or more jolting devices. The preferred jolting device 22 comprises a vibrationally drivable, obliquely extendable (45°–90°) jolting plate 23 which comes to rest against the suspended cluster. A swingable suspension is provided, by means of which the cluster 3 can be swung in the transport hook 19 into different positions, so that the conveyor 17 is not unnecessarily affected by the jolting. The suspension 24 can be connected to the jolting plate 23, the jolting plate 23 being swingable from a vertical position into an oblique position in which the suspension 24 simultaneously takes over the clusters 3 from the transport hook 19. Other jolting arrangements are usable.

Upon the jolting, the remaining molding sand 21 is removed from the cluster 3 and taken up by the discharge shaft 12. Then only traces of completely burned molding sand remain directly adhering to the surface of the cluster 3. They detach themselves substantially entirely during the passage through the secondary cooling path. In order to be able to receive the remaining molding sand, a hook 25 for a collecting plate 26 which can be suspended thereon is associated with each transport hook 19, it being located and carried along below the cluster 3. The collecting plates 26 are transferred by a transfer device from a point of the conveyor 17 to the jolting device 22.

The residues of burnt molding sand are no longer fed to the old sand treatment plant but are discharged for disposal. Thus, the process also automatically effects a separation of the old sand into a reusable portion and a non-reusable portion, the quantity of the latter being about 1% by weight.

At the end of the secondary cooling path a device is provided for automatic engagement of the clusters 3 at the two sprues 9 in order to insert the cluster 3 into a machine for separating the castings 6 from the runner and gating system. The separated castings 6 are then fed to a blasting machine (as is known is the art).

It may be advantageous to provide two parallel molded-clump shafts 11 which open into the discharge shaft and which alternately receive a molded clump.

Residual sand from the molded clump 5 which remains in the shaft 11 as it falls down into the discharge shaft 12 are ejected by the next molded clump 5.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A device for the casting and unpacking cast clusters comprises a casting station, a primary cooling path downstream of the casting station, an unpacking station downstream of the primary cooling path and a secondary cooling path downstream of the unpacking station, said unpacking station comprises a shaft for receiving a molded clump, said shaft opening over a discharge shaft; a transport hook means disposed over said discharge shaft for receiving a molded casting cluster from said shaft; conveyor means associated with said transport hook for guiding said transport hook and molded casting cluster along a path over said discharge shaft to the secondary cooling path; and a collecting plate supported on said conveyor means below the casting cluster transport hook.

2. A device for the casting and unpacking cast clusters comprises a casting station, a primary cooling path downstream of the casting station, an unpacking station downstream of the primary cooling path and a secondary cooling path downstream of the unpacking station, said unpacking station comprises a shaft for receiving a molded clump, said shaft opening over a discharge shaft; a transport hook means disposed over said discharge shaft for receiving a molded casting cluster from said shaft; conveyor means associated with said transport hook for guiding said transport hook and molded casting cluster along a path over said discharge shaft to the secondary cooling path; jolt means comprising a drivable obliquely extendable jolting plate located along said conveyor guiding path for jolting said molded casting cluster whereby molding sand falls from the cluster into the discharge shaft; and means for moving said jolting plate against said molded casting cluster for jolting said molded casting cluster.

* * * * *